United States Patent [19]

Kump

[11] 3,984,953

[45] Oct. 12, 1976

[54] TRANSPORT CONFIGURATION FOR A MODULAR ENVIRONMENTAL SPACE MODULE

[76] Inventor: Ernest Joseph Kump, 360 Everett Ave., Apt. 2C, Palo Alto, Calif. 94301

[22] Filed: Nov. 22, 1974

[21] Appl. No.: 526,114

[52] U.S. Cl. ..... 52/143; 52/79; 220/4 F

[51] Int. Cl.[2] ..... E04H 1/12

[58] Field of Search ..... 52/79, 143; 206/321, 206/325; 220/4 F

[56] References Cited

UNITED STATES PATENTS

| | | | |
|---|---|---|---|
| 3,023,463 | 3/1962 | Bigelow | 52/143 |
| 3,530,982 | 9/1970 | Bigelow | 206/321 |
| 3,620,246 | 11/1971 | Shoquist | 52/79 |
| 3,633,323 | 1/1972 | Eriksson | 52/143 |
| 3,680,273 | 8/1972 | Bigelow | 52/143 |
| 3,707,811 | 1/1973 | Hampson | 52/143 |
| 3,727,753 | 4/1973 | Starr | 206/321 |
| 3,791,080 | 2/1974 | Sjoberg | 52/143 |
| 3,838,545 | 10/1974 | Kump | 52/79 |

*Primary Examiner*—Ernest R. Purser
*Assistant Examiner*—Henry Raduazo
*Attorney, Agent, or Firm*—Flehr, Hohbach, Test, Albritton & Herbert

[57] ABSTRACT

A transport assembly for a modular environmental space module has a shipping shell having two shell halves which define a shipping package volume therebetween. One of the shipping shell halves serves as a roof component for an erected space module and the other shell half may serve as a portion of a shipping container or as a floor component for an erected space module. Within the package volume wall components are positioned in stacked relationship. The wall components extend between the roof component and an underlying surface or the floor component in an erected space module. A floor component may be included within the package volume together with opening frame components for interspersing with the wall components in the erected space module for providing access and light openings in the walls. Support jacks may also be included within the package volume for supporting the erected space module. The support jacks are configured to extend between the lower portions of the opening frame components and an underlying support surface or member. A utility manifold may be contained within the package volume beneath the floor component, located in its functioning position, whereby the erected space module may be connected to preselected utilities. Means for attaching the various space module components together to form the erected module may also be included within the package volume.

7 Claims, 9 Drawing Figures

FIG. 2
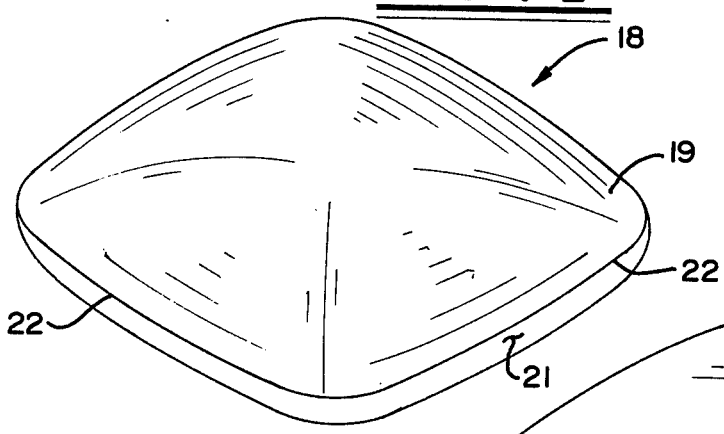
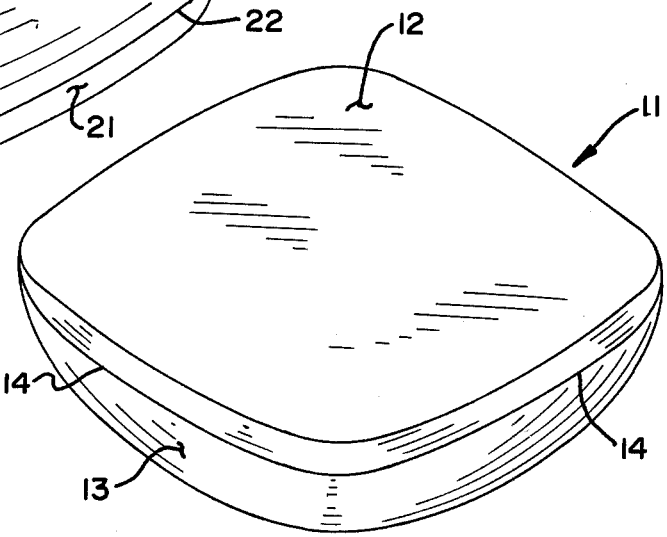
FIG. 1
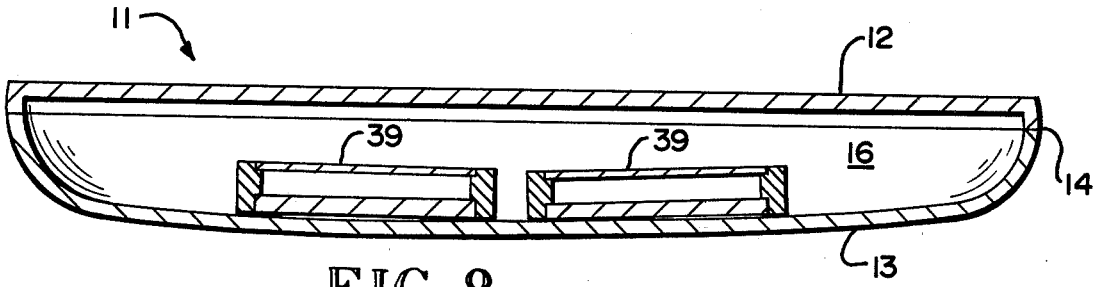
FIG. 8
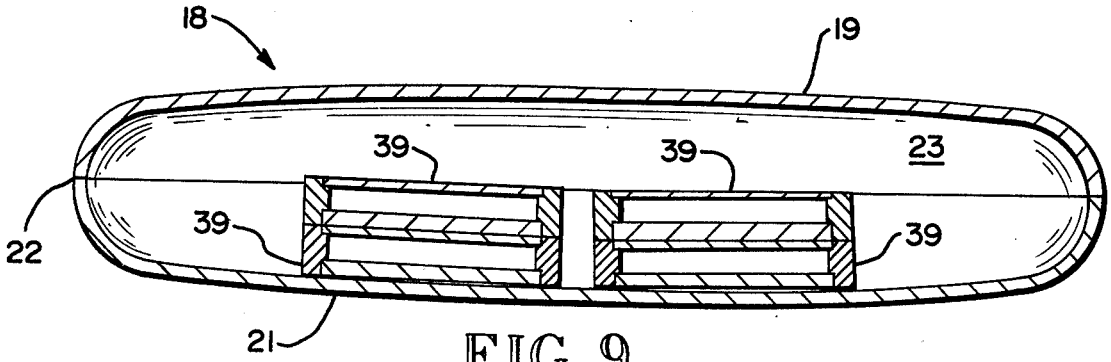
FIG. 9

FIG. 3
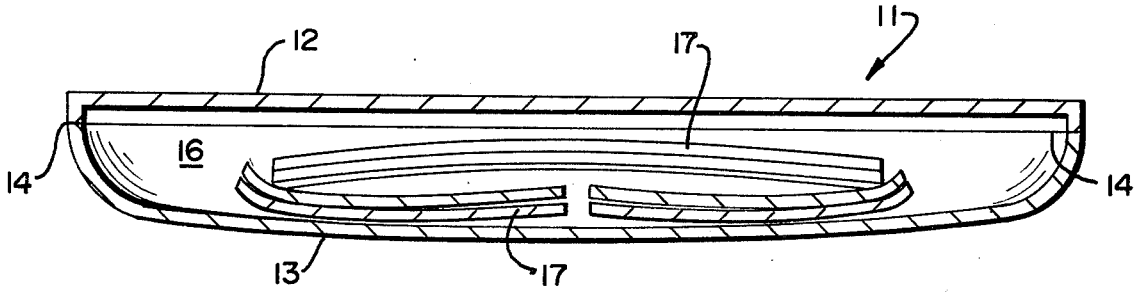
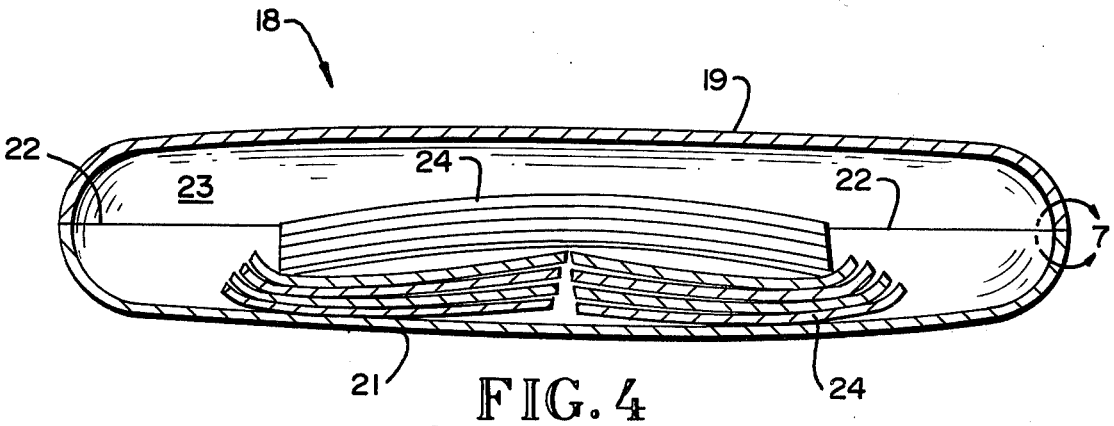
FIG. 4
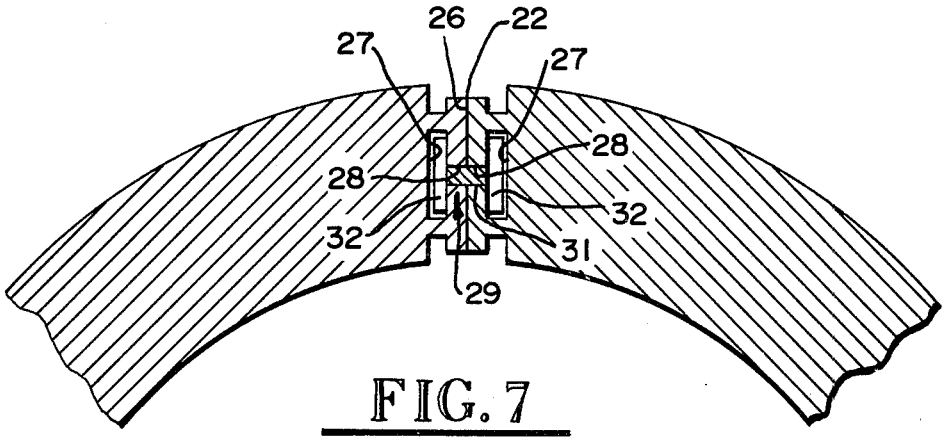
FIG. 7

FIG. 5
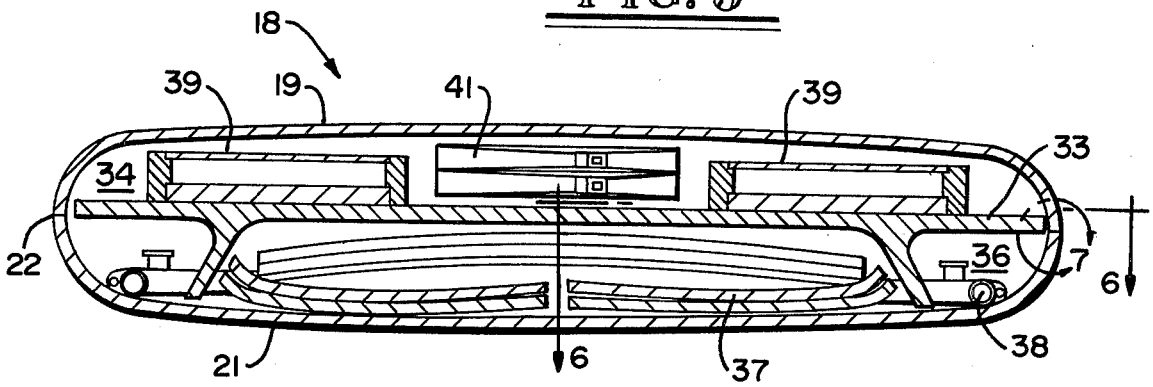
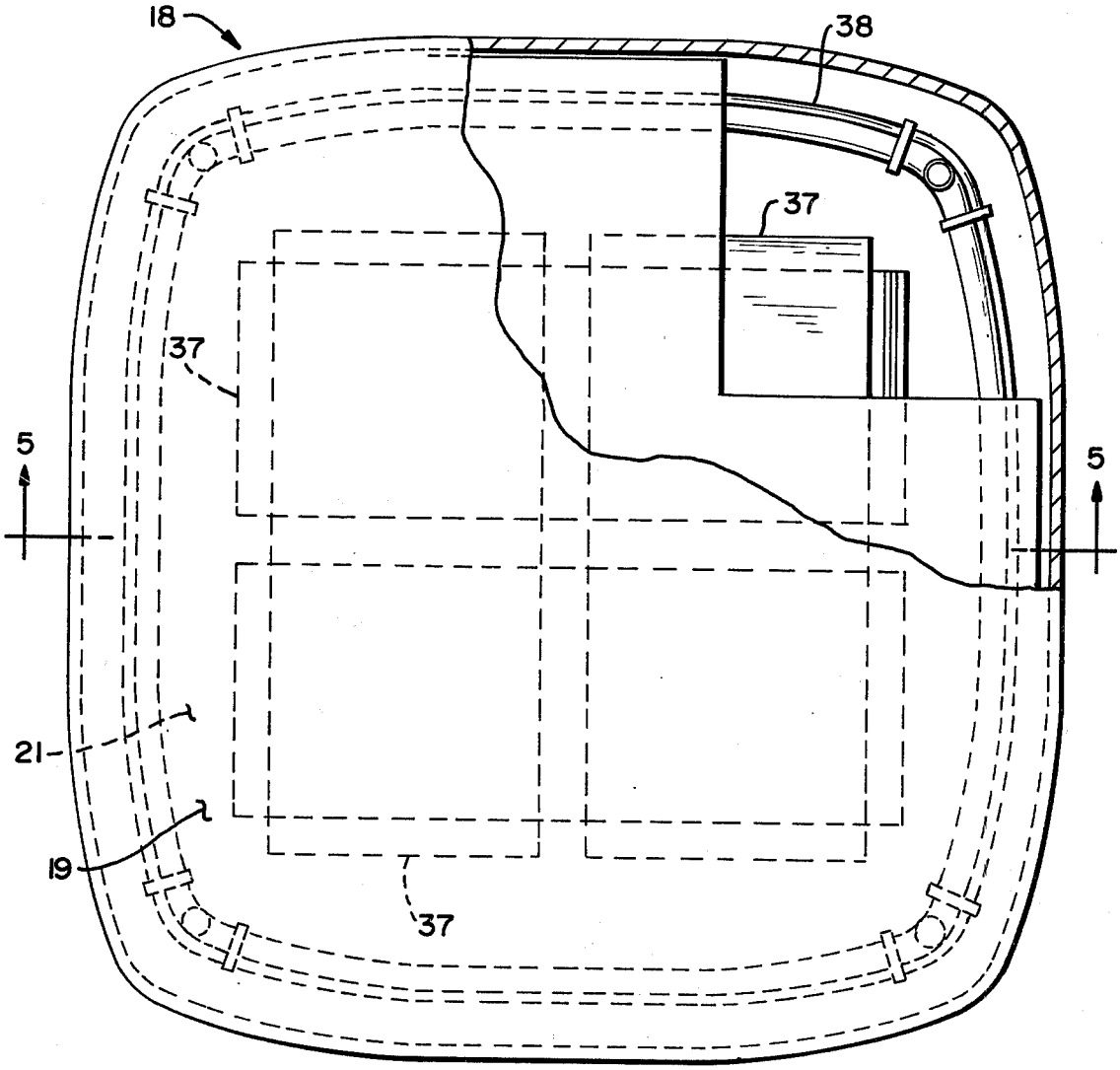
FIG. 6

TRANSPORT CONFIGURATION FOR A MODULAR ENVIRONMENTAL SPACE MODULE

CROSS REFERENCES

In U.S. Letters Pat. No. 3,838,545, entitled MODULAR ENVIRONMENTAL SPACE MODULE, issued Oct. 1, 1974, a living space module is disclosed. These space modules have a variety of desired interior configurations, wall openings, and ultimate uses, which may be predetermined at a manufacturing facility. These space modules are for use in a BUILDING SYSTEM AND COMPONENTS THEREFOR as described in U.S. Letters Pat. No. 3,712,007. The BUILDING SYSTEM envisions a multitude of individual dwellings comprised of a number of SPACE MODULES which may be integrated into entire communities using different combinations of standardized components.

BACKGROUND OF THE INVENTION

This invention relates generally to a transport container assembly for a modular environmental space module which, in erected form, defines an enclosed living space, and more particularly to a space module transport assembly which contains all of the necessary components for a predetermined space module configuration.

The above referenced building system and space module has great utility as described in those respective disclosures. However, some means for transporting these space modules to construction sites where the building systems are to be erected is necessary, since the most immediate needs fulfilled by the referenced construction is in underdeveloped areas of the world which are in most cases distant from potential manufacturing sources of the space modules and the variety of collateral equipment which may be contained therein. Since economy of construction skills and materials is paramount in the building systems containing the space module, it is in keeping with these principles that an efficient means and method of transporting the space modules and associated equipment be devised.

SUMMARY AND OBJECTS OF THE INVENTION

A shipping container assembly includes two shell halves which define a package volume therebetween. The two shell halves are securely joined at the edges by fastening means which may subsequently be used for fastening structural components together when the space module is erected at a construction site. One of the shell halves serves as a roof component for the constructed module and the other shell half may serve to provide underlying support for the erected module. Wall components are contained in stacked formation within the package volume, and are formed to extend between the roof component and the underlying support in the erected configuration. The wall components provide for separations therebetween for access to the interior of the space module. Opening frame components may also be included for disposition in the openings between the wall components, and a utility manifold may be included within the package volume for provision of gas, electricity, and waste removal, for example.

It is a general object of the present invention to provide a transport assembly for a modular environmental space module which affords a package for efficient module transportation.

It is another object of the present invention to provide a transport assembly for a modular environmental space module which may contain only those components and accessories which are necessary for a predetermined configuration of erected space modules.

Additional objects and features of the invention will appear from the following description in which the preferred embodiment has been set forth in detail in conjunction with the accompanying drawings.

BRIEF DESCRIPTION OF THE DRAWINGS

FIG. 1 is an isometric view of the exterior of a transport assembly for a modular environmental space module.

FIG. 2 is an isometric view of another embodiment of the transport assembly for the modular environmental space module.

FIG. 3 is a sectional view of the embodiment of FIG. 1.

FIG. 4 is a sectional view of one embodiment of the transport assembly of FIG. 2.

FIG. 5 is a sectional view of an additional embodiment of the transport assembly of FIG. 2.

FIG. 6 is a cutaway sectional plan view of the embodiment of FIG. 5.

FIG. 7 is a detail view of a fastening means for the edges of the outer container members of the transport assembly of FIGS. 4 and 5.

FIG. 8 is a sectional view of an additional embodiment of the transport assembly of FIG. 1.

FIG. 9 is a sectional view of an additional embodiment of the transport assembly of FIG. 2.

DESCRIPTION OF THE PREFERRED EMBODIMENTS

Referring to FIG. 1 one embodiment of a transport assembly 11 for the modular building structure is seen. The assembly of FIG. 1 has a planar shell half 12 and a concavo-convex shell half 13. Shell halves 12 and 13 are securely joined at their edges 14 to prevent separation during shipment.

Turning to FIG. 3 a sectional view is shown of the transport assembly configuration of FIG. 1 wherein a package volume 16 is defined between planar shell half 12 and concavo-convex shell half 13. A plurality of wall components 17 are shown in stacked relationship within package volume 16. Shell halves 12 and 13 are secured together at edges 14 by any appropriate means so that the integrity of package volume 16 is maintained throughout the shipping process.

The configuration of FIG. 3 may be disassembled and erected at a construction site utilizing concavo-convex shell half 13 as a roof component. Wall components 17 are configured to extend between concavo-convex shell half 13 and an underlying support surface. The underlying support surface may be provided by planar shell half 12, in which case a modular environmental space module may be constructed having a roof component 13, wall components 17, and an underlying support surface or floor 12. Wall components 17 are configured to afford at least one opening therethrough in the erected space module for access to the module.

Referring to FIG. 2 an isometric view of another embodiment of an assembled transport assembly 18 for a modular environmental space module is shown. Assembly 18 has a top concavo-convex shell half 19 and a bottom concavo-convex shell half 21. Concavo-convex shell halves 19 and 21 are securely joined together at the edges 22 thereof.

Referring to FIG. 4 a sectional view of one embodiment of the transport assembly of FIG. 2 is shown. Top and bottom shell halves 19 and 21 define a package volume 23 therebetween. Contained within package volume 23 are a plurality of wall components 24 positioned in stacked relationship. Shell half edges 22 are securely fastened together by an appropriate means.

One appropriate means by which edges 22 may be securely fastened together is shown in FIG. 7. As disclosed in copending patent application, Ser. No. 519,572, for a JOINT ASSEMBLY AND FASTENER THEREFOR, abutting faces 26 at the edges of shell halves 19 and 21 have channels 27 running therebehind. Elongate openings 28 are formed in abutting faces 26 overlying one another when edges 22 are in engagement. An elongate fastener 29 has a fastener body 31 extending through openings 28. Each edge of body 31 has attached thereto a plurality of lateral members 32 for engaging the surfaces of the channels 27 immediately behind abutting faces 26.

The transport assembly of FIG. 4 may be disassembled and erected at a construction site to form a pair of shelters. Both concavo-convex shell halves 19 and 21 may serve as roof components. Wall components 24 are provided for extending from each shell half 19 and 21 to an underlying support surface. Wall components 24 may be fastened to each of shell halves 19 and 21 by means such as those shown in FIG. 7 when wall components 24 have abutting faces 26, channels 27 and elongate openings 28 formed therein at the top edges thereof. Package volume 23 is adequate to contain a sufficient number of wall components 24 to provide for the desired enclosure while also providing access to the enclosures by way of openings between the wall components 24.

Turning now to FIG. 5 a sectional view of another embodiment of the transport assembly 18 is shown. Top shell half 19 and bottom shell half 21 define a package volume 23 therebetween when the edges 22 thereof are joined as described above. In the embodiment of FIG. 5 a floor component 33 is shown which separates package volume 23 into an upper storage volume 34 and a lower storage volume 36. Lower storage volume 36 contains a plurality of wall components 37 in stacked position and a utility manifold 38 which is mounted in its operational or functioning position in bottom shell half 21. Upper storage volume 34 may contain a plurality of wall opening frame components 39 in side by side position adjacent floor component 33. Centrally located in upper storage volume 34 there may be a plurality of support jacks 41 for use as hereinafter described. Means such as those shown in FIG. 7 described above may be used for fastening the edges 22 of top and bottom shell halves 19 and 21 securely together for providing a transport assembly for the modular environmental space module. Additional means such as elongate fastener 29 may be stored within upper or lower storage volumes 34 and 36 respectively for fastening wall components 37 to top and bottom shell halves 19 and 21 respectively when the transport assembly is disassembled for erection at a construction site.

FIG. 6 is a cutaway sectional plan view of the transport assembly of FIG. 5 showing the utility manifold 38 in place in its operational position and the manner in which the stacked wall components 37 are placed in the assembly.

The transport assembly of FIGS. 5 and 6, when disassembled at a construction site, provides the components necessary to erect a modular environmental space module having a roof component comprised of top shell half 19, and a floor component comprised of bottom shell half 21, together with floor components 33, and utility manifold 38 in place and available for connection to outside utility outlets. Wall components 37 are configured to extend between edge 22 on the roof component provided by top shell half 19 and edge 22 on bottom shell half 21 which provides an underlying support surface. Openings between wall components 37 in the erected space module may be filled by opening frame components 39 for providing access to the interior of the space module. When the space modules are supported in combination as shown in the referenced U.S. Letters Pat. No. 3,712,007, support jacks 41 contact the underlying edges of opening frame components 39 as disclosed therein for supporting the space modules.

FIG. 8 shows the transport assembly of FIG. 1 with a plurality of opening frame components 39 within the package volume 16. Shell halves 12 and 13 are secured together as described above.

The configuration of FIG. 8 may be disassembled and erected at a construction site utilizing concavo-convex shell half 13 as a roof component. Frame components 39 are configured to extend between shell half 13 and an underlying support surface. The underlying support surface may be provided by planar shell half 12. A modular space module having a roof 13, side frame members 39, and a floor 12 results. Such a structure may subsequently be covered with cloth or plastic sheet, for example, to provide an enclosure.

FIG. 9 shows the transport assembly of FIG. 2 with a plurality of opening frame components 39 contained within package volume 23. Shell halves 19 and 21 are secured together as described above.

The transport assembly of FIG. 9 may be disassembled at a construction site and constructed to form a pair of structures with overhead roof components 19 and 21 each supported by several frame components 39 which extend between each of the roof components and an underlying support surface when the space module is erected. A pair of structures with roofs 19 and 21, side frame members 39 and a floor results. The two modular structures may be covered with plastic or cloth to provide two enclosures as described for FIG. 8 above.

A transport or shipping assembly has been disclosed for modular environmental space modules which provides a shipping package of minimal volume and which also utilizes shipping package structural elements as space module structural elements when the space modules are erected at the desired construction site.

I claim:

1. A shipping assembly for transporting or storing a modular building structure, comprising a first concavo-convex shell half, a second concavo-convex shell half having a configuration for use as a roof component in the modular building structure, said first and second shell halves having faces around the edges thereof for abutting contact at all points therealong, whereby a single continuous seal line exists therebetween, means for joining said first and second shell halves at the edges thereof so that said shell halves define a package volume therebetween, a plurality of wall components centrally located within said package volume, said wall components being of a configuration for attaching to and extending between said first and second shell halves, a floor component supported within said package volume and a lower storage volume, said floor component being supported by members disposed toward the periphery thereof so that access to said lower storage volume is obtained by removal of said floor component, said plurality of wall components being positioned in said lower storage volume, a plurality of opening frames disposed within said package volume in said upper storage volume for interspersing with said wall components extending between said first and second shell halves in the erected modular building structure, whereby said package volume integrity is improved by said single seal line feature and components for erecting a modular building structure having a roof, floor and walls are provided when the shipping assembly is delivered to a construction site.

2. A shipping assembly as in claim 1 together with a utility manifold assembled in place in said first shell half for providing utilities to the modular building structure.

3. A shipping assembly as in claim 1 together with means within said package volume for contacting an under side of ones of said opening frames when the modular building structure is erected, for providing support therefore.

4. A transport container for a modular environmental space module comprising a top container half configured to serve as a module roof component, a bottom container half configured to serve as a module bottom component, said top and bottom container halves providing a container volume therebetween and having continuous faces extending around the edges thereof for abutting engagement therebetween for maintaining the integrity of said container volume, a plurality of wall components stored centrally within said container volume in stacked relation, said wall components formed to extend between said module roof component and module bottom component in the erected module, a planar floor member, said planar floor member being removably supported in said bottom container half by a plurality of members attached thereto and extending therefrom for contacting said bottom container half inner surface toward the edges thereof, whereby said container volume is separated into first and second storage volumes, said wall components being stored in said first storage volumes, and a plurality of frame components in side by side relation in said second storage volume, said frame components formed to extend between said module roof component and said module bottom component for placement between ones of said wall components in the erected module, whereby access and light openings in the module walls are provided, and means for fastening said top and bottom container halves together at said continuous faces, thereby forming a single continuous seal line therearound.

5. A transport container as in claim 4 together with a utility manifold positioned in said first storage volume surrounding said plurality of members, and support jacks centrally located in said second storage volume, said support jacks adapted to fasten to a fixed support for said space module and being configured to attach to said frame components.

6. A shipping container for transporting or storing a modular building structure comprising a first concavo-convex shell half, a second concavo-convex shell half having a shape similar to that of said first concavo-convex shell half, said first shell half having a face extending around the edge thereof, said second shell half having a face extending around the edge thereof for abutting contact with the face on said first shell half for forming a continuous single seal line therearound, thereby maintaining the integrity of the shipping container and defining a container volume between said first and second shell halves, a removable floor member, support members attached to said removable floor member and spaced from the center thereof for supporting said removable floor member in said second shell half thereby separating said container volume into first and second storage volumes, a plurality of wall components stored centrally within said first storage volume in stacked relation, said plurality of wall components formed to extend between said faces on said first and second shell halves in the erected module, and means for securing said faces on said first and second shell halves in abutting relation.

7. A transport container as in claim 6 together with a utility manifold positioned in said first storage volume.

* * * * *